US008070407B2

(12) United States Patent
Sasamoto

(10) Patent No.: US 8,070,407 B2
(45) Date of Patent: Dec. 6, 2011

(54) SHEET BUNDLE CONVEYING APPARATUS, AND BOOKBINDING APPARATUS

(75) Inventor: Shinya Sasamoto, Hokuto (JP)

(73) Assignee: Nisca Corporation, Yamanashi (JP)

( * ) Notice: Subject to any disclaimer, the term of this patent is extended or adjusted under 35 U.S.C. 154(b) by 1281 days.

(21) Appl. No.: 11/730,629

(22) Filed: Apr. 3, 2007

(65) Prior Publication Data

US 2007/0237559 A1 Oct. 11, 2007

(30) Foreign Application Priority Data

Apr. 7, 2006 (JP) ..... 2006-106688

(51) Int. Cl.

| | |
|---|---|
| ***B42D 1/00*** | (2006.01) |
| ***B42C 9/00*** | (2006.01) |
| ***B42C 11/00*** | (2006.01) |
| ***B42C 11/02*** | (2006.01) |
| ***B42C 5/02*** | (2006.01) |
| ***B42B 9/00*** | (2006.01) |

(52) U.S. Cl. ..... 412/11; 281/21.1; 412/9; 412/18; 412/19; 412/30; 412/33

(58) Field of Classification Search ..... 281/3.1, 281/4, 15.1, 17, 19.1, 21.1, 29, 51; 283/63.1, 283/64, 117; 412/1, 4, 6, 8, 9, 11, 18, 19, 412/25, 30, 33, 37, 900, 901
See application file for complete search history.

(56) References Cited

U.S. PATENT DOCUMENTS

| | | | | |
|---|---|---|---|---|
| 6,213,456 | B1 * | 4/2001 | Hirano et al. | 412/4 |
| 2004/0141830 | A1 | 7/2004 | Yoshie et al. | |
| 2005/0078970 | A1 | 4/2005 | Kim | |
| 2007/0086876 | A1 * | 4/2007 | Sanmiya et al. | 412/9 |

FOREIGN PATENT DOCUMENTS

| | | | |
|---|---|---|---|
| JP | 2004-209869 | A | 7/2004 |
| JP | 2005265935 | A * | 9/2005 |

* cited by examiner

*Primary Examiner* — Dana Ross
*Assistant Examiner* — Justin Lewis
(74) *Attorney, Agent, or Firm* — Manabu Kanesaka

(57) ABSTRACT

A sheet bundle conveying device includes a tray device on which sheets are placed and held in a bundle, a sheet bundle conveying path along which a sheet bundle from the tray device is guided to a predetermined processing position, a grip transferring device located on the sheet bundle conveying path for gripping and transferring the sheet bundle from the tray device to a processing position, and a grip controlling device for controlling the grip transferring device. When an apparatus error occurs, the grip transferring device moves the conveyed sheet bundle backward to the collection stage. A grip on the sheet bundle is released on the collection stage after the sheet bundle is returned.

6 Claims, 10 Drawing Sheets

SHEET BUNDLE CONVEYING APPARATUS, AND BOOKBINDING APPARATUS

BACKGROUND OF THE INVENTION AND RELATED ART STATEMENT

The present invention relates to a sheet bundle conveying apparatus wherein grip means are used to grip and convey bundled sheets to a predetermined position in a bookbinding apparatus that aligns sequentially supplied print sheets into a bundle and then binding them to a cover sheet with a paste or any other adhesive.

Sheet bundle conveying devices that collect and, for example, align sheets into a bundle and transfer the sheet bundle to a processing position are widely used for various bookbinding apparatus and postprocess apparatus for image forming apparatus. These sheet bundle conveying devices use a grip conveying mechanism that uses gripper means to grip and convey the sheet bundle to the processing position.

A conventional book binding apparatus comprising a grip conveying mechanism is disclosed in Japanese Patent Laid-Open No. 2004-209869. This document proposes an apparatus that stacks and aligns sheets printed by an image forming apparatus, such as a printer or a printing machine, on a stacking tray in order of pages, conveys the bundled sheets to a predetermined paste applying position, and places the sheet bundle with a paste applied thereto, in the cover sheet. The mechanism conveying the sheet bundle from the stacking tray to the predetermined paste applying position uses a pair of grippers, comprising an upper gripper and a lower gripper, to clamp the sheet bundle. The mechanism then moves the grippers along a path to convey the sheet bundle. Moreover, the apparatus disclosed in the document collects bundled sheets on the stacking tray in a horizontal posture, uses the grippers to change the posture of sheet bundle to a vertical one, applies a paste to the sheet bundle in the vertical posture, and conveys a cover sheet to a downstream position where the cover sheet is bound to the sheet bundle.

Consequently, the sheets from the image forming apparatus are collected in a horizontal posture and then moved along the path while being supported in the vertical posture. During this process, the sheets are subjected to sequential bookbinding steps. Thus, in the apparatus disclosed in Japanese Patent Laid-Open No. 2004-206369, when an apparatus error, for example, jamming or power interruption, occurs during the bookbinding process, a sheet bundle that has not been completely processed is left in the apparatus. Then, when the apparatus is restarted, the remaining sheets are removed from the apparatus and a normal bookbinding process is then continued.

As described above, when the grip conveying mechanism conveys the sheet bundle from the stacking tray means to the downstream processing position, if the apparatus is stopped for any reason with the sheet bundle gripped by the grip conveying mechanism, the conventional technique requires the operator to perform a recovery operation, such as removing the sheet bundle gripped by the grip conveying mechanism in order to return the apparatus to its initial state and then restarting the apparatus. However, to remove the bundled sheets from the grip conveying mechanism, the grip force of the grip conveying mechanism must be released. In this case, loosened sheets may fall and scatter in the apparatus. In particular, with the path configuration in which the sheet bundle is conveyed in the vertical posture, if the timing for releasing the grip force of the grip conveying mechanism does not coincide with the timing when the operator receives the sheet bundle, the sheets may fall and scatter. Removal of the fallen sheets is dangerous and cumbersome.

In view of the above problems, an object of the present invention is to provide a method and device for transferring a sheet bundle which, if a bookbinding apparatus is irregularly stopped during a bookbinding process, allows a sheet bundle remaining in the device to be easily removed, preventing the sheets from scattering.

Another object of the present invention is to provide a bookbinding apparatus wherein, when sheets from an image forming apparatus are subjected to an automatic bookbinding process and if the bookbinding apparatus is irregularly stopped, a sheet bundle remaining in the bookbinding apparatus is automatically conveyed to a predetermined takeout position to enable an effective operation without the need to remove the remaining sheets.

The other objects and features of the present invention will be apparent from the description below of embodiments taken in conjunction with the accompanying drawings.

SUMMARY OF THE INVENTION

To accomplish the above objects, the present invention adopts the following convention. The expression "when an error occurs in a bookbinding apparatus" as used herein, refers to the case where the apparatus is stopped because of a malfunction such as jamming, or where the apparatus power supply is turned off by power interruption, or for any other reason that stops the device. According to the present invention, a sheet bundle conveying device comprises tray means on which sheets are placed and held in a bundle, a sheet bundle conveying path along which a sheet bundle from the tray means is guided to a predetermined processing position, grip transferring means located on the sheet bundle conveying path for gripping and transferring the sheet bundle from the tray means to the processing position, and grip control means for controlling the grip transferring means.

The grip control means is configured so that when an apparatus error occurs, it moves the grip transferring means backward along the sheet bundle conveying path and cancels gripping to return the sheet bundle being transferred, to the tray means. Thus, when an apparatus error occurs, the sheet bundle gripped by the grip transferring means is returned to the upstream tray means. The sheet bundle can thus be easily removed from the tray means.

A bookbinding apparatus according to the present invention comprises tray means on which sequentially carried out sheets are collected in a bundle, a sheet bundle conveying path along which a sheet bundle from the tray means is guided to an adhesive applying position, grip transferring means located on the sheet bundle conveying path for gripping and transferring the sheet bundle from the tray means to the adhesive applying position, grip control means for controlling the grip transferring means, adhesive applying means located at the adhesive applying position for applying an adhesive to the sheet bundle supported by the grip transferring means, cover sheet binding means located on the sheet bundle conveying path for binding a cover sheet to the sheet bundle from the adhesive applying position, and a cover sheet conveying path along which the cover sheet is fed to the cover sheet binding means.

The grip control means is configured so that when an apparatus error occurs, it moves the grip transferring means backward along the sheet bundle conveying path and cancels gripping to return the sheet bundle being transferred, to the tray means. In this case, the grip transferring means comprises first gripper means for carrying the sheet bundle out from the tray means and second gripper means for receiving the sheet bundle from the first gripper means and conveying the sheet bundle to the adhesive applying position. When an apparatus error occurs, the grip transferring means returns a sheet bundle being transferred by the first gripper means, to the tray means, and transfers a sheet bundle being transferred by the second gripper means, to the adhesive applying position, where an adhesive is applied to the sheet bundle, which is then carried out of the apparatus without being bound. Thus, when an apparatus error occurs, the sheet bundle gripped by the gripper means is returned to the upstream tray means or is bound with an adhesive by the downstream adhesive applying means and then carried out of the apparatus.

As described above, according to the present invention, if an apparatus error occurs while the sheet bundle is being conveyed from the tray means toward the predetermined processing position by the grip transferring means, the grip transferring means returns the sheet bundle being conveyed, to the upstream tray means to release the grip force. This prevents a gripped sheet bundle from remaining in the apparatus and allows a remaining sheet bundle to be easily removed. Consequently, a recovery operation can be easily performed when an apparatus error occurs. In particular, with a path configuration in which the sheet bundle is conveyed in a substantially vertical posture, when the remaining sheet bundle is removed, the present invention prevents the sheets from falling or scattering.

Further, the apparatus is configured so that when the sheet bundle being conveyed from the tray means toward a processing position, e.g., the adhesive applying position, is left in the apparatus, the remaining sheet bundle is conveyed depending on its position. That is, when positioned upstream, the sheet bundle is returned to the tray means, and when the sheet bundle is positioned downstream, an adhesive is applied to the sheet bundle, which is then carried out of the apparatus. This configuration has the effect that when an error occurs in the bookbinding apparatus, bundled sheets are prevented from scattering and it is unnecessary to execute a complicated process for removing the sheet bundle from the grip transferring means.

DETAILED DESCRIPTION OF PREFERRED EMBODIMENTS

Figure 1:
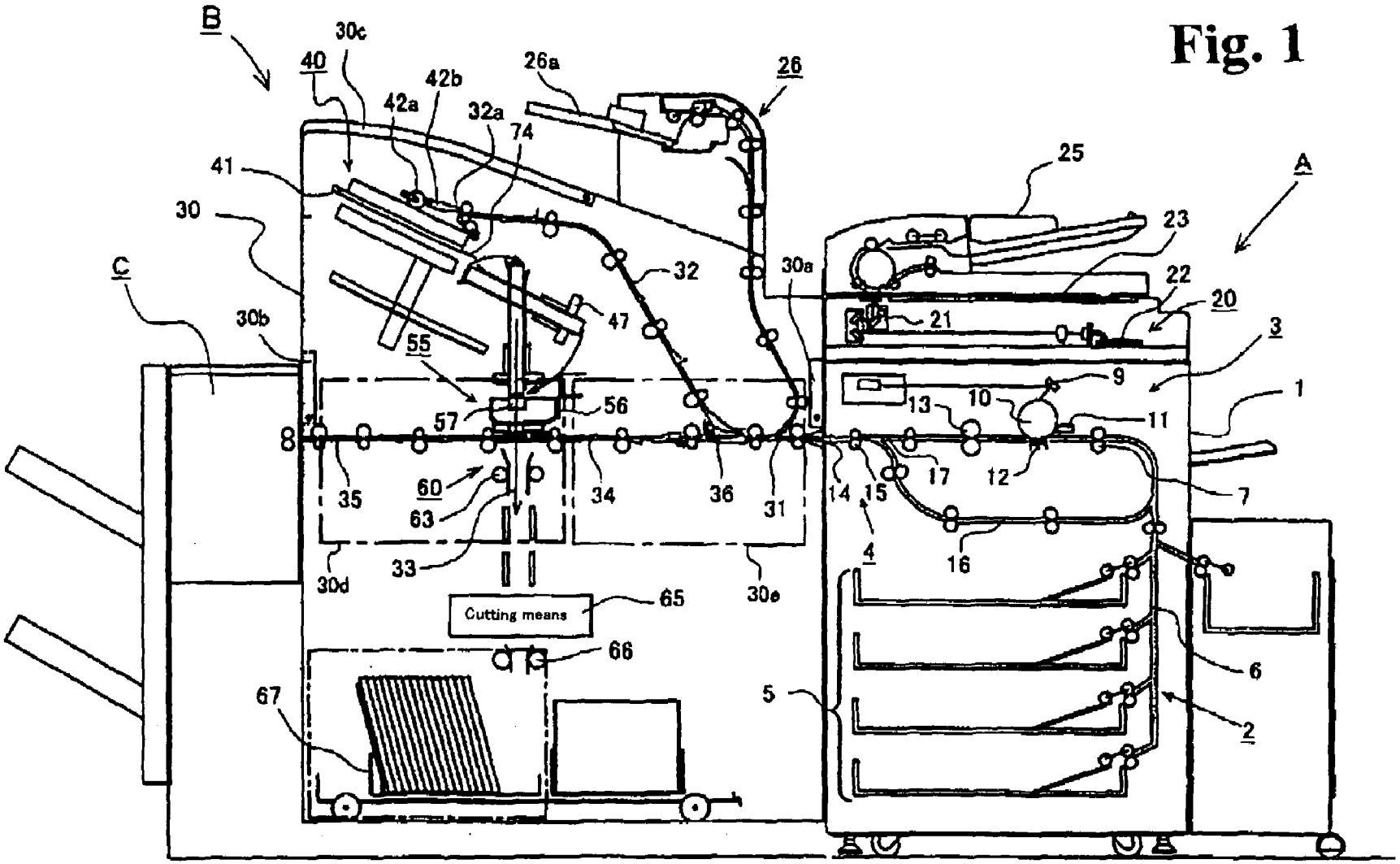
FIG. 1 is a diagram showing the general configuration of an image forming apparatus in accordance with the present invention.
Figure 2:
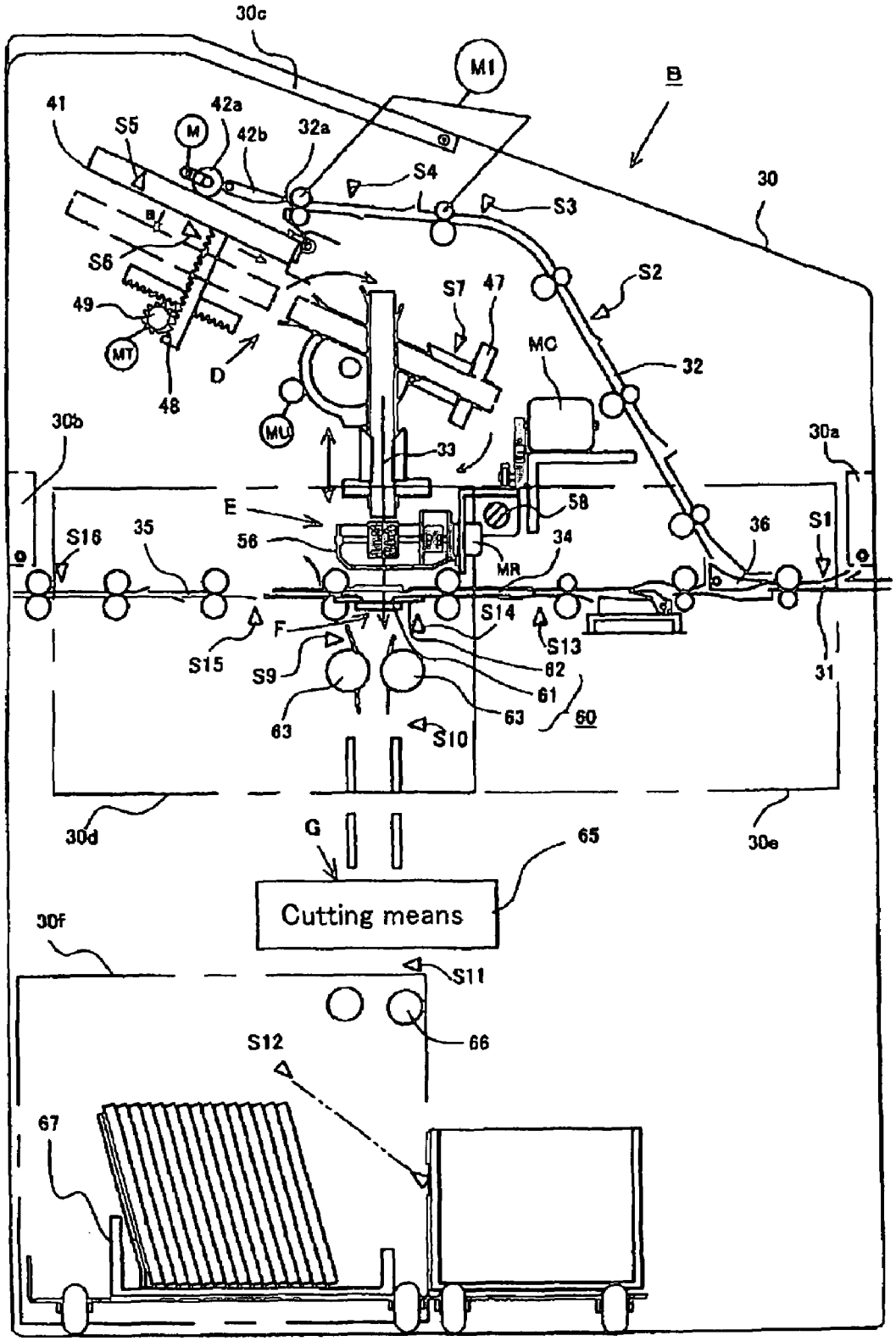
FIG. 2 is a detailed diagram showing a book binding apparatus in the system in FIG. 1.

With reference to the drawings, a detailed description will be given of embodiments of a sheet feeding device and an image reading device in accordance with the present invention. FIG. 1 is a diagram illustrating the general configurations of a bookbinding apparatus containing a sheet bundle conveying apparatus in accordance with the present invention as well as an image forming system using the bookbinding apparatus. FIG. 2 is a detailed diagram illustrating the bookbinding apparatus.

The image forming system shown in FIG. 1 is composed of an image forming apparatus A that sequentially prints sheets, a bookbinding apparatus B installed downstream of the image forming apparatus A, and a finisher apparatus C located downstream of the bookbinding apparatus B. Sheets on which images have been formed by the image forming apparatus are subjected to a bookbinding process by the bookbinding apparatus B. Sheets not subjected to a bookbinding process are passed through the bookbinding apparatus B to the finisher apparatus C, which then executes a postprocess on the printed sheets.

The image forming apparatus A may have any of various structures; it may be a copier, a printer, a printing machine, or the like. The illustrated image forming apparatus A is an electrostatic printing apparatus. The image forming apparatus A has a casing 1 containing a sheet feeding section 2, a printing section 3, a sheet discharging section 4, and a control section 24 (see FIG. 9). The sheet feeding section 2 has a plurality of cassettes 5 with varying sheet sizes so as to allow sheets of a size specified by the control section 24 to be fed to a sheet feeding path 6. A registration roller 7 is provided on the sheet feeding path 6 to align sheets at their leading ends and then feed them to the downstream printing section 3 at a predetermined timing.

The printing section 3 has an electrostatic drum 10 surrounded by a print head 9, a developing unit 11, a transfer charger 12, and the like. The print head 9 comprises, for example, a laser light emitter to form an electrostatic latent image on the electrostatic drum 10. The developing unit 11 attaches toner ink to the latent image, which is then printed on a sheet by the transfer charger 12. A fixer 13 then performs a fixing operation on the sheet Sp, which is then conveyed out to a sheet discharging path 17. The sheet discharging section 4 has a sheet discharging port 14 and a sheet discharging roller 15 both formed in the casing 1. Reference numeral 16 in the figure denotes a circulating path along which the printed sheet Sp from the sheet discharging path 17 is reversed via a switchback path and then fed to the registration roller 7 again, where an image is formed on the back surface of the printed sheet Sp.

The printed sheet Sp with an image thus formed on one or both surfaces thereof is conveyed through the sheet discharging port 14 by the sheet discharging roller 15.

Reference numeral 20 denotes a scanner unit that optically reads a document image printed by the print head 9. As is generally known, the scanner unit is composed of a platen 23 on which a document sheet is placed and set, a carriage 21 that scans the document image along the platen 23, and optical reading means (for example, a CCD device) 22 for photoelectrically converting an optical image from the carriage 21. In the illustrated scanner unit, a document feeder 25 is installed on the platen 23 to automatically feed the document sheet to the platen.

The bookbinding apparatus B, combined with the image forming apparatus A, is now described. The bookbinding apparatus B is composed of tray means 40 for collecting and aligning printed sheets Sp in a bundle in the casing 30, adhesive applying means 55 for applying a paste to the sheet bundle from the tray means 40, and cover sheet binding means 60 for binding a cover sheet to the sheet bundle with the adhesive applied thereto. A saddle-stitched sheet conveying path 32 is located upstream of the tray means 40, and a bookbinding process path 33 is located downstream of the tray means 40. The tray means 40 is composed of a placement tray (hereinafter referred to as a "tray") placed in a substantially horizontal direction. Printed sheets Sp from a sheet discharging port 32*a* of the saddle-stitched sheet conveying path 32 are stacked and housed in the tray means 40.

A forward rotating roller 42*a* and a carry-in guide 42*b* are provided above the tray 41. The carry-in guide 42*b* guides the printed sheet Sp from the sheet discharging port 32*a* to above the tray 41, and the forward rotating roller 42*a* houses the printed sheet Sp on the tray 41. The forward rotating roller 42*a* rotates forward to house the printed sheet Sp on the tray 41 and rotates backward to abut the trailing end of the sheet against a regulator 43 located at the trailing end of the tray (the right edge in FIG. 1). The tray 41 also has aligning means (not shown) for aligning opposite side edges of the printed sheets Sp housed on the tray, with a reference position. This configuration allows the printed sheets Sp from the saddle-stitched sheet conveying path 32 to be sequentially stacked on the tray 41 and aligned in a bundle.

Sheet conveying paths is be described. The casing 30 contains a sheet carry-in path 31, saddle-stitched sheet conveying path 32, a bookbinding process path 33, a cover sheet conveying path 34, and a sheet discharging path 35 arranged as shown in FIG. 1. The sheet carry-in path 31 is continuous with the sheet discharging port 14 in the image forming apparatus A and receives printed sheets Sp from the image forming apparatus A. In this case, the following printed sheets are carried out of the image forming apparatus A: printed sheets (saddle-stitched sheets) Sp with contents information printed thereon and a printed sheet (hereinafter referred to as a cover sheet Sh) used as a cover sheet and on which a tile or the like is printed. The sheet carry-in path 31 then branches into the saddle-stitched sheet conveying path 32 and the cover sheet conveying path 34 and distributes the printed sheets to the respective paths via a path switching flapper 36.

Cover sheets are not printed by the image forming apparatus A and an inserter unit 26 is connected to the sheet carry-in path 31 to separate each cover sheet from the sheet feeding tray 26*a* and to feed it to the sheet carry-in path 13. The tray 41 is connected to the saddle-stitched sheet conveying path 32, with the bookbinding process path 33 located downstream of the tray 41. The bookbinding process path 33 executes a bookbinding process on the saddle-stitched sheets (hereinafter simply referred to as a "sheet bundle") Sp collected in a bundle, while sequentially transferring the sheet bundle. The bookbinding process path 33 is placed in a substantially vertical direction, and a sheet bundle posture changing position D, an adhesive applying position E, a cover sheet binding position F, and a cutting process position G are arranged on the downstream side of the bookbinding process path 33 in this order. The cover sheet conveying path 34 crosses the bookbinding process path 33 at the cover sheet binding position F to feed the cover sheet Sh to the cover sheet binding position F.

Figure 6:
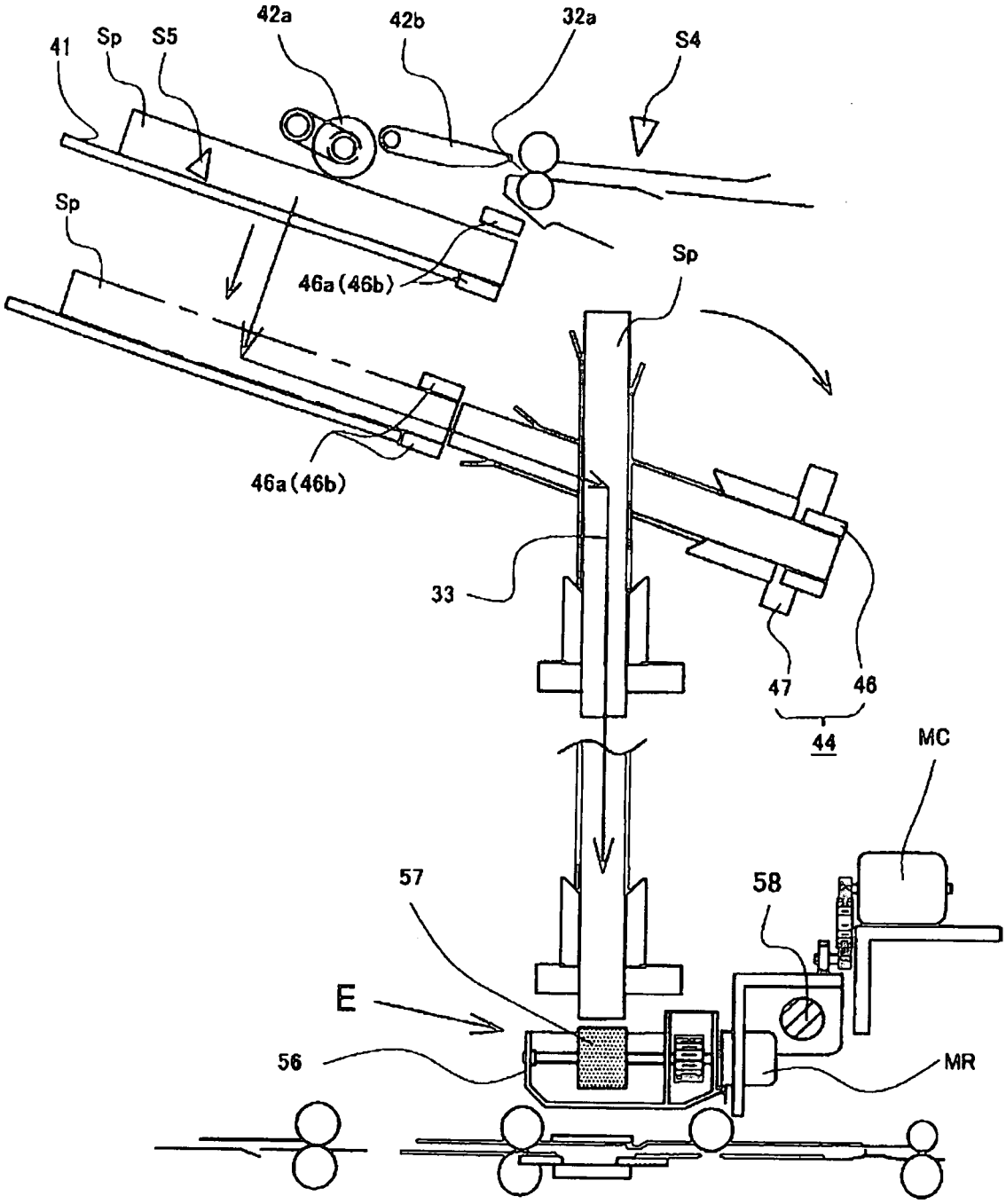
FIG. 6 is a detailed diagram illustrating a bookbinding process path (sheet bundle conveying path) of the apparatus in FIG. 2.
Figure 7A:
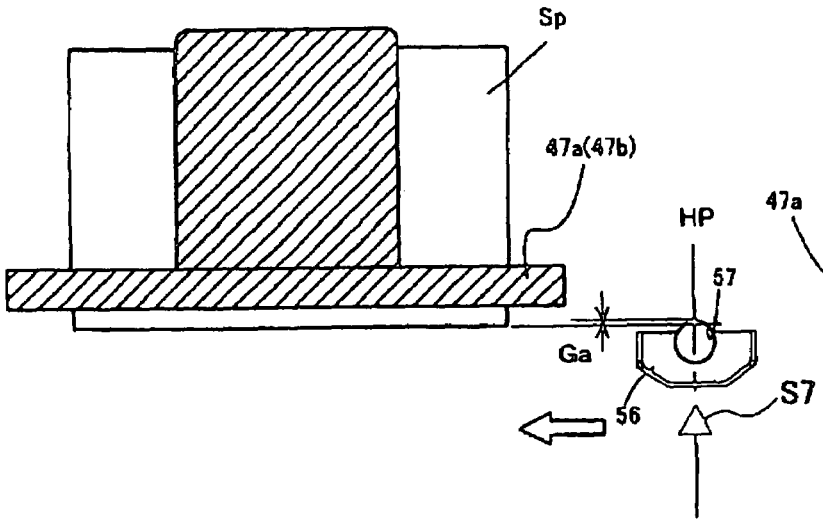
FIGS. 7(*a*)-7(*d*) are diagrams illustrating the operating condition of an applying operation performed in an adhesive housing container in FIG. 5, wherein FIG. 7(*a*) shows that adhesive applying means is at its home position, FIG. 7(*b*) shows that the adhesive applying means is moving backward, FIG. 7(*c*) is a sectional view of FIG. 7(*a*), and FIG. 7(*d*) is a sectional view of FIG. 7(*b*)
Figure 7C:
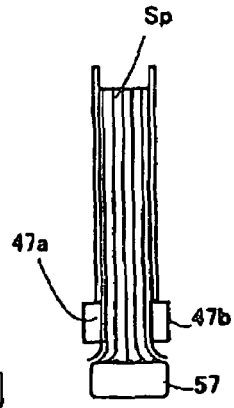
Figure 7B:
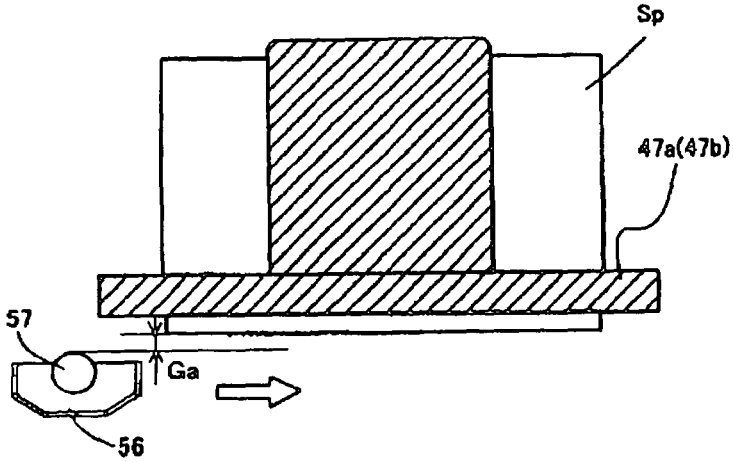
Figure 7D:
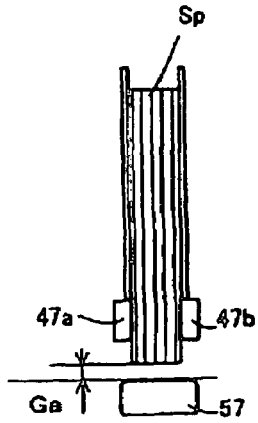
Figure 8A:
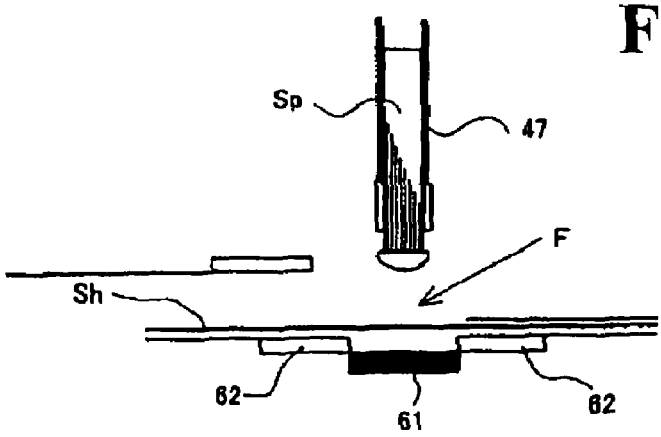
FIGS. 8(*a*)-8(*d*) are diagrams illustrating the operating condition of sheet binding means in the apparatus in FIG. 2, wherein FIG. 8(*a*) shows a condition immediately before a cover sheet is joined to a sheet bundle S, FIG. 8(*b*) shows a backup plate supporting the cover sheet Sh, FIG. 8(*c*) shows the rear portions of the sheet bundle and cover sheet being press-molded, FIG. 8(*d*) shows the sheet cover being folded onto the sheet bundle.
Figure 8B:
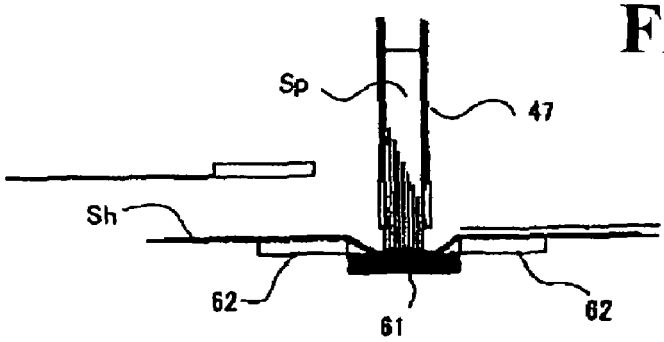
Figure 8C:
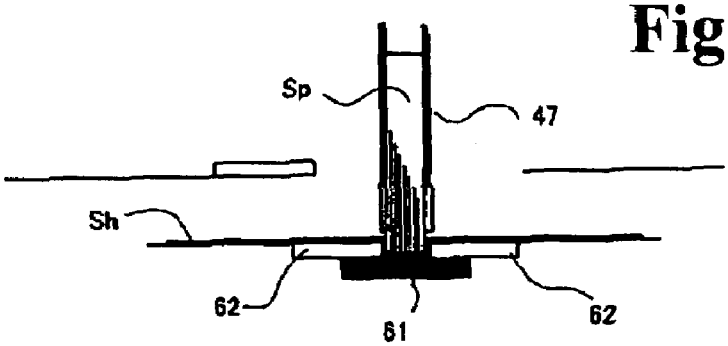
Figure 8D:
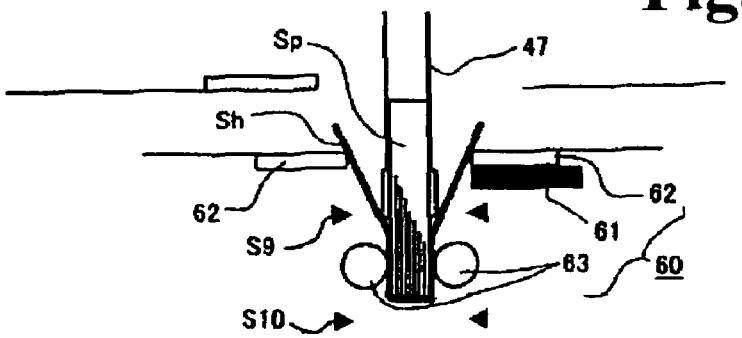

On the bookbinding process path 33, the adhesive applying means 55 is located at the adhesive applying position E. The adhesive applying means 55 is composed of a paste container 56 that accommodates a hot-melt adhesive, an application roller 57, and a roller rotating motor MR. The application roller 57 and the roller rotating motor MR are incorporated into the paste container 56 (see FIG. 6). The paste container 56 is supported so as to be able to move along the sheet bundle Sp set at the adhesive applying position E. As shown in FIG. 6, the paste container 56 is slidably supported on a guide rail (guide shaft) 58 provided on an apparatus frame and is fixed to a driving belt coupled to a carriage motor MC. The carriage motor MC rotates forward to reciprocate the paste container 56 along the longitudinal direction of the sheet bundle Sp from front to back and back to front of the sheet of FIG. 6.

The carriage motor MC moves forward from its home position HP shown in FIG. 7(*a*) along the longitudinal direction of the sheet bundle Sp, and moves backward as shown in FIG. 7(*b*) to return to the home position HP. During this process, on the forward path, the application roller 57 is pressed hard against an end surface of the sheet bundle Sp (FIG. 7(*c*)) to loosen the sheet edges. On the backward path, a small gap (FIG. 7(*d*)) is formed between the roller surface and the end surface of the sheet bundle, and an adhesive is applied to the roller surface so as to rise therefrom. The distance between the roller surface and the end surface of the sheet bundle is adjusted by allowing second gripper means 47 described below to adjust the position of the grippers (the vertical postures in FIGS. 7(*a*) and 7(*b*)). Increasing the size of a gap Ga increase the amount of adhesive applied to the sheet bundle Sp; varying the size of the gap Gp enables the adjustment of the amount of adhesive applied to the sheet bundle Sp.

Grip transferring means 44 is located on the bookbinding process path 33 to transfer sheets from the tray 44 to the adhesive applying position E. Thus, the posture of the sheet bundle Sp collected on the tray 41 needs to be changed from a horizontal one to a vertical one. The bookbinding process path 33 has a sheet bundle posture changing position D where the tray 41 moves from a collection position (shown with a full line in FIG. 2) to a delivery position (shown with a chained line in FIG. 2). The tray 41 then delivers the sheet bundle Sp to the second gripper means 47, provided at the delivery position. The configuration of the grip transferring means 44 is described below.

The cover sheet binding means 60 is located at the cover sheet binding position F on the bookbinding process path 33. The cover sheet conveying path 34 is located at the cover sheet binding position F so as to cross it. The cover sheet Sh is fed along the cover sheet conveying path 34, and at the cover sheet binding position F, the sheet bundle Sp from the adhesive applying position E is encased in the cover sheet Sh. Thus, the following are provided at the cover sheet binding position F: a backup plate 61 that backs up the cover sheet Sh, a press block 62 that press-molds the junction (rear portions) of the sheet bundle Sp and cover sheet Sh, and folding rolls 63. The backup plate 61, press block 62, and folding rolls 63 constitute the cover sheet binding means 60, which executes a casing-in process as shown in FIGS. 8(*a*) to 8(*d*).

FIG. 8(*a*) shows a condition immediately before the cover sheet Sh is joined to the sheet bundle Sp. The sheet bundle Sp has been moved downward in the figure by the second gripper means 47. Then, as shown in FIG. 8(*b*), the sheet bundle Sp is abutted against the center of the cover sheet Sh backed up by the backup plate 61. On the other hand, the press block 62 has a lateral pair of blocks configured so as to be able to move between a retracted position where the blocks are retracted from the bookbinding process path 33 and an operative position where the blocks are pressed against each other in the bookbinding process path 33. As shown in FIG. 8(*c*), while moving from the retracted position to the operative position, the press block 62 press-molds the rear portions of the sheet bundle Sp and cover sheet Sh. After the press molding, the backup plate 61 and the press block 62 are retracted from the bookbinding process path 33. The resulting sheet bundle Sp is moved downstream by the second gripper means 47. Then, the folding rolls 63 fold the cover sheet Sh onto the sheet bundle Sp (as shown in FIG. 8(*d*)). This allows the sheet bundle (saddle-stitched sheets) Sp to be cased in the cover sheet Sh.

A cutting means 65 (not shown) is placed at the cutting process position G, located downstream of the folding rolls 63. The cutting means 65 trims the periphery of the sheet bundle Sp processed into a booklet by a predetermined amount except for the rear portions. A carry-out roller 66 and a housing stacker 67 are arranged downstream of the cutting process position G. The sheet bundle Sp is housed in the housing stacker 67 so as to be inverted, as shown in the figure.

Now, description will be given of the grip transferring means 44 located on the bookbinding process path 33 and relating to the sheet bundle conveying device in accordance with the present invention. As described above, the tray 41 aligns the sheets in a substantially horizontal posture, and at the downstream processing position (the adhesive applying position E, described above), holds the sheet bundle Sp in a substantially vertical posture. That is, the sheet bundle conveying path (the bookbinding process path, described above) 33 is formed between the tray 41 and the processing position E. The sheet bundle Sp collected in the tray 41 has its direction changed in the sheet bundle conveying path 33 and is then conveyed to the processing position E. In the illustrated apparatus, the tray 41 is configured so as to be able to elevate and lower freely between a collected position where the sheets are collected and a carry-out position where the sheets are carried out. This is to make the apparatus layout compact. The tray 41 is supported on the apparatus frame so as to be movable along the guide rail or the like in the vertical direction of FIG. 2. The tray 41 is coupled to a tray elevating and lowering motor MT via, for example, a rack 48 and a pinion 49. The tray elevating and lowering motor Mt rotates forward and backward to elevate and lower the tray 41 between the stacked position and the carry-out position.

Figure 3:
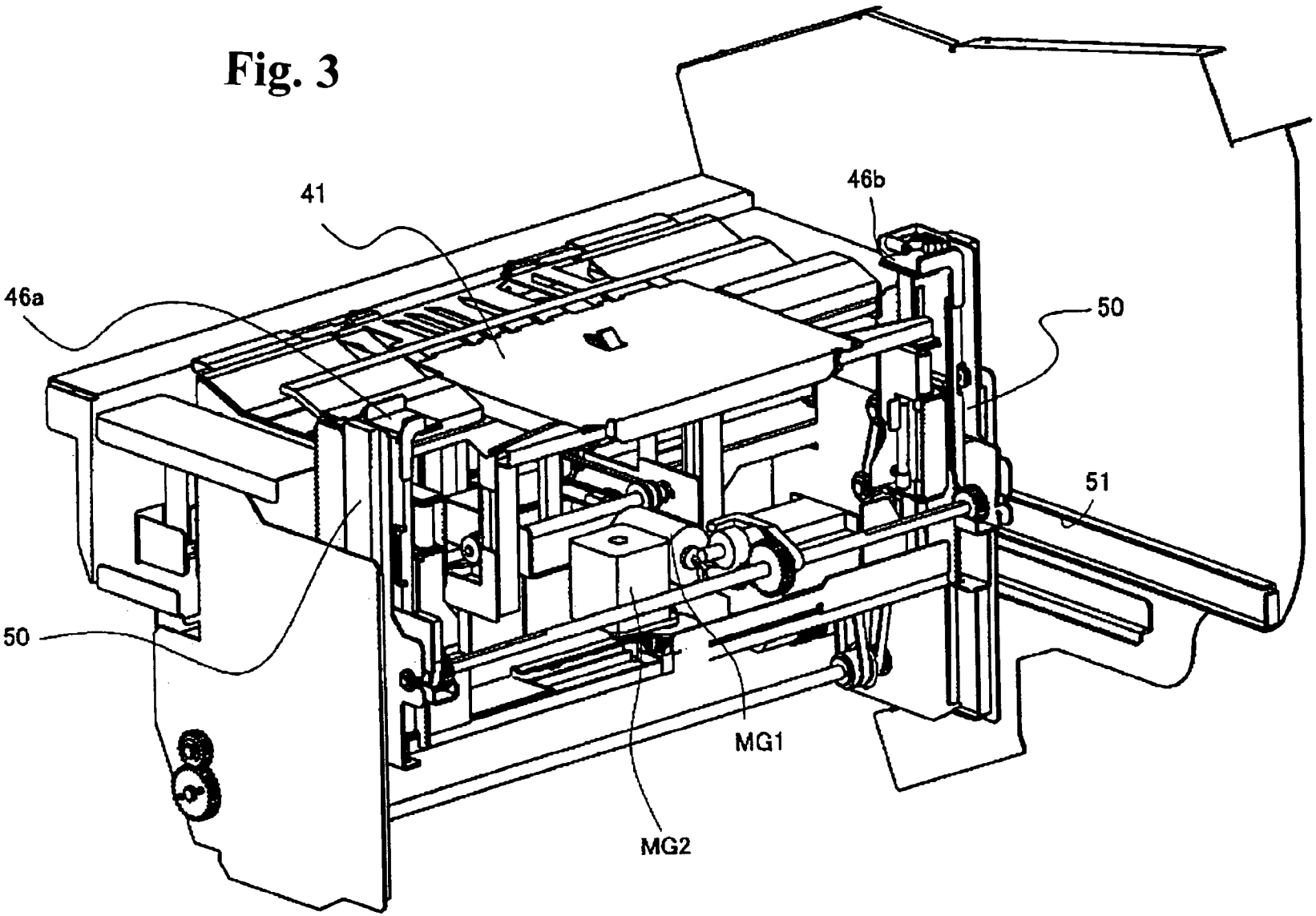
FIG. 3 is a diagram illustrating the operating condition of a tray gripper located on a placement tray in the apparatus in FIG. 2.

Thus, the grip transferring means 44 is composed of first gripper means 46 that holds the sheet bundle Sp so as to prevent the sheet bundle Sp from being misaligned while the tray 41 is elevating or lowering, and second gripper means 47 that receives the sheet bundle Sp from the first gripper means 46 to convey the sheet bundle Sp to the processing position E. The first gripper means 46 is composed of a lateral pair of grippers 46*a* and 46*b* that grip a corner of the sheet bundle Sp, as shown in FIG. 3. Each of the grippers 46*a* and 46*b* comprises a fixed gripper and a movable gripper to which a gripper motor MG1 is coupled. The pair of grippers 46*a* and 46*b* is supported by a lateral pair of stems 50 supported on the apparatus frame so as to be movable in a sheet width direction. The pair of grippers 46*a* and 46*b* is coupled to a widthwise moving motor MG2.

Figure 4A:
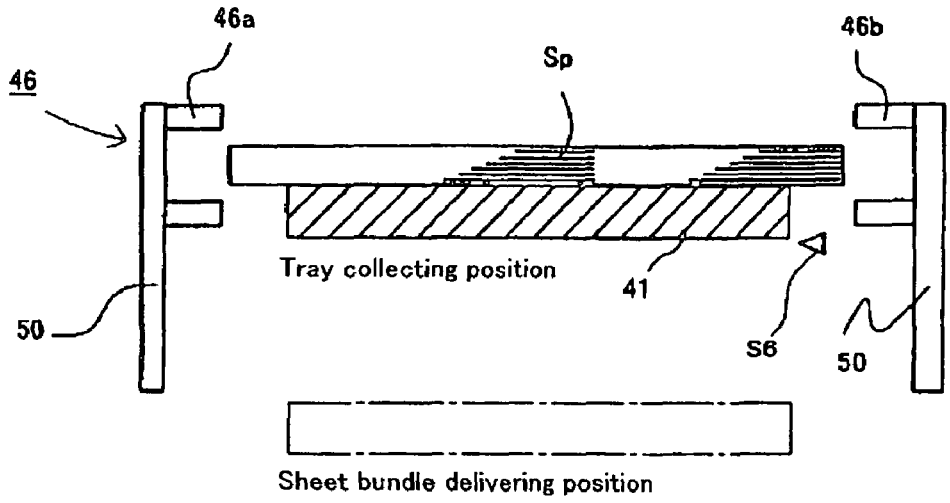
FIGS. 4(*a*)-4(*c*) are diagrams illustrating the structure of grip transferring means (first gripper means) in the apparatus in FIG. 2, wherein FIG. 4(*a*) illustrates the grip transferring means in a retracted position, FIG. 4(*b*) shows the grip transferring means holding a sheet bundle, and FIG. 4(*c*) illustrates that the sheet bundle has been delivered.
Figure 4B:
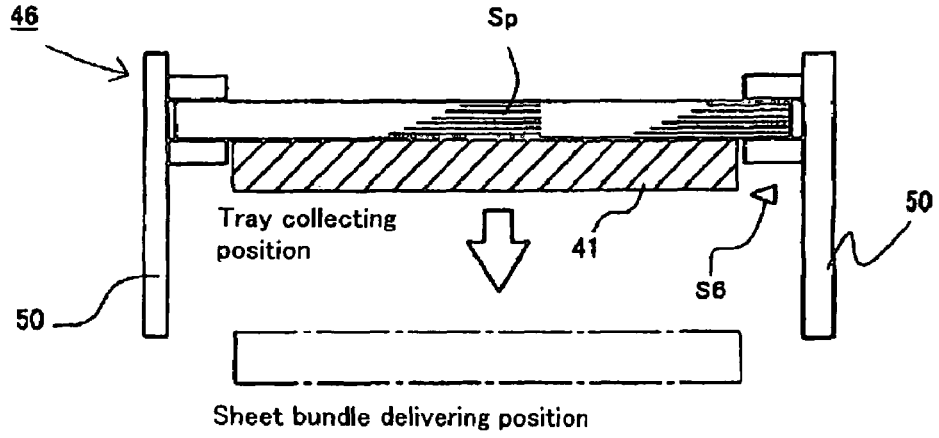
Figure 4C:
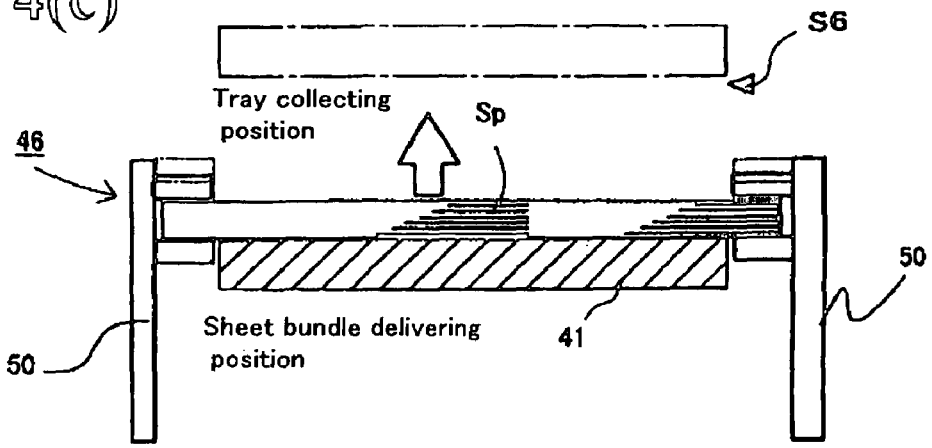

Accordingly, when the sheets stacked on the tray 41, as shown in FIGS. 4(*a*)-4(*c*), are carried out, the stems 50 in the condition shown in FIG. 4(*a*) move from a retracted position to respective sheet corners depending on the sheet width. Then, the movable gripper (the upper gripper in the figure) moves to hold the sheets as shown in FIG. 4(*b*). The first gripper means 46 lowers from the collected position to the carry-out position together with the tray 41. Then, in the condition shown in FIG. 4(*c*), the first gripper means 46 separates from the tray 41 and delivers the sheet bundle to the downstream second gripper means 47. Thus, the stems 50 are movably supported by the guide rails 51 (see FIG. 3) on the apparatus frame.

Figure 5:
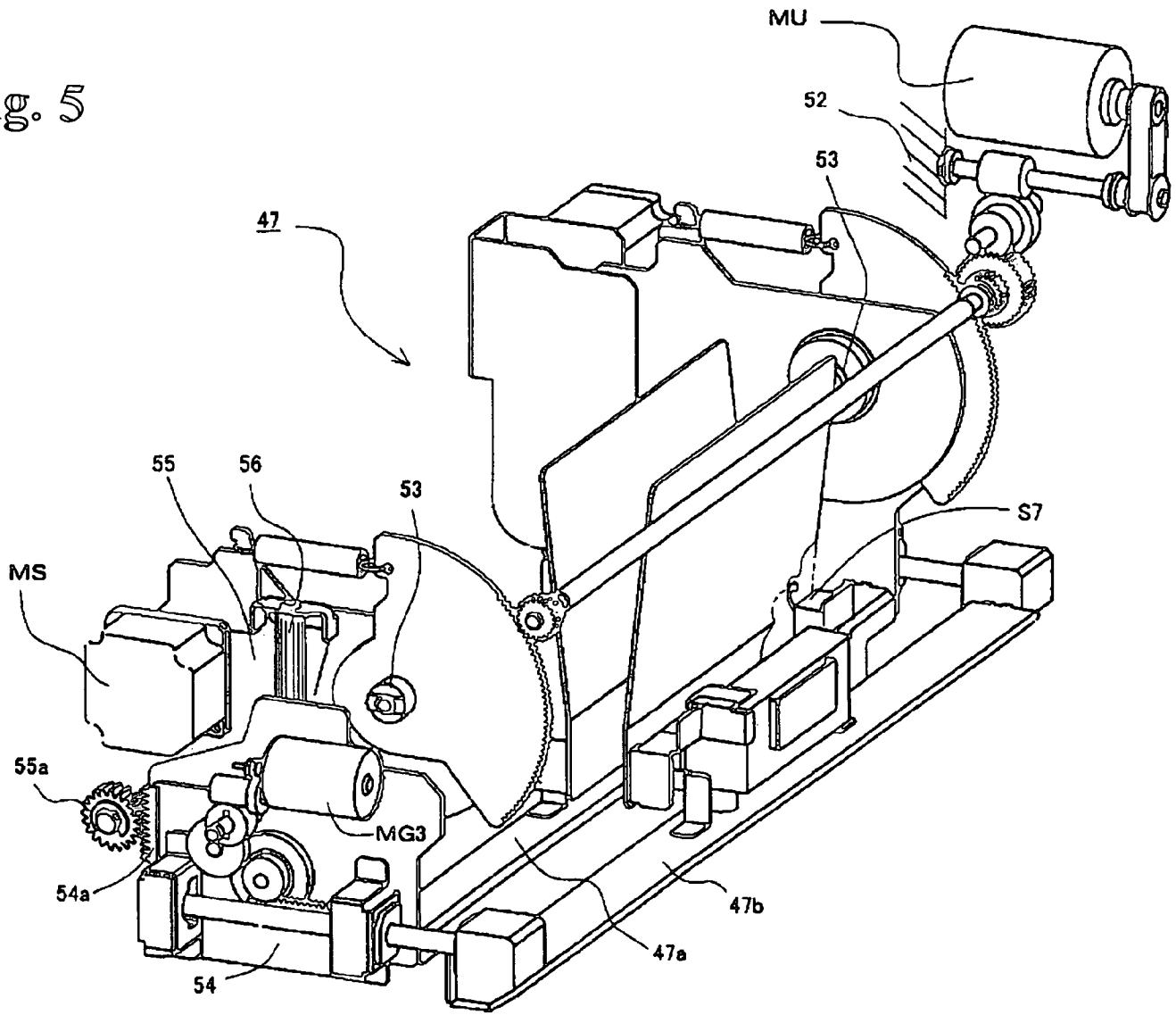
FIG. 5 is a diagram illustrating the structure of grip transferring means (second grip transferring means) in the apparatus of FIG. 2.

The second gripper means 47 is configured as shown in FIG. 5. The second gripper means 47 receives the sheets from the tray 41 as described above and rotates them through 90° to set them in a vertical posture. The second gripper means 47 then transfers the sheets along the sheet bundle conveying path 33 to the processing position E. Thus, as shown in FIG. 5, the second gripper means 47 comprises a pair of grippers 47*a* and 47*b* that grips the sheet bundle Sp and a gripper unit including a grip motor MG3 that allows the grippers to perform a grip operation. The gripper unit (second gripper means) 47 is supported by an apparatus frame 52 so as to be pivotable via a rotating shaft 53 and is pivoted by a unit rotating motor MU located closer to the apparatus frame. The gripper unit 47 includes a fixed gripper 47*a* and a movable gripper 47*b*. The movable gripper 47*b* is moved closer to and away from the fixed gripper 47*a* by a grip motor MG3.

Further, the movable and fixed grippers 47*a* and 47*b* are supported by a gripper frame 54 together with the grip motor MG3. The gripper frame 54 is supported by the unit frame 55 so as to be movable along a guide rail 56 in the vertical direction of FIG. 5. The gripper frame 54 is driven in the vertical direction by a shift motor MS via a pinion 55*a* and a rack 54*a*. With the gripper unit 47 configured as described above, the grip motor MG3 causes the grippers 47*a* and 47*b* to grip the sheet bundle Sp on the tray 41. The unit rotating motor MU changes the posture of the sheet bundle Sp from the horizontal one to the vertical one. Then, the sheet bundle Sp in the vertical posture is gripped by the grippers 47*a* and 47*b* and transferred downstream along the sheet bundle conveying path (bookbinding process path) 33 by the shift motor MS.

The bookbinding apparatus configured as described above is controlled as follows. First, a sensor that detects sheets (sheet bundle) is located on each path. As shown in FIG. 2, an inlet sensor S1 is placed on the sheet carry-in path 31 at the illustrated position. Sheet sensors S2 and S3 and a sheet discharging sensor S4 are arranged on the saddle-stitched sheet conveying path 32 to detect the passage of sheets. The tray 41 has a tray sensor S5 that detects the presence or absence of a sheet, and a tray position sensor S6. The second gripper means 47 has a gripper sensor S7 that detects the presence or absence of a sheet bundle. The tray position sensor S6 detects whether or not the tray 41 is located at its home position corresponding to the collection position.

The paste container 56 of the adhesive applying means 55 has a paste container HP sensor S8 at its home position and sheet sensors S9 and S10 at the positions of the folding rolls 63 as shown in the figure. Further, a sheet sensor S11 is placed at the position of the carry-out roller 66. A full-stacker sensor S12 is placed on the housing stacker 67. Sheet sensors S13 and S14 are placed on the cover sheet conveying path 34.

Sheet sensors S15 and S16 are arranged on the sheet discharging path 35. Each of these sensors detects the leading or trailing end of sheets passing through the corresponding path to control the feeding of the following sheets, while monitoring the condition of the sheets in the path.

Moreover, for each path, the casing 30 has a cover located as described below and which can be opened and closed like a door, in order to allow sheets (bundle) remaining as a result of jamming to be removed from the path. An inlet cover 30*a* is disposed on the sheet carry-in path 31. A sheet discharging cover 30*b* is disposed on the sheet discharging path 35. A top cover 30*c* is disposed above the tray 41. These covers allow sheets (bundle) to be removed when an error such as jamming occurs. Similarly, door-like covers 30*d* and 30*e* are disposed in the front of the apparatus (the forefront of FIG. 2) to open the cover sheet conveying path 34. A door-like cover 30*f* is disposed on the housing stacker 67 to draw it toward the front of the apparatus. The opening and closing covers 30*a* to 30*f* disposed on the casing 30 each have a safety switch having a normal configuration to detect when the cover is opened to turn off the apparatus power supply.

In the above configuration, the present invention is characterized in that when the apparatus power supply is turned off, the sheet bundle Sp gripped by the grip transferring means 44 is returned to the upstream tray 41. This operation will be described with reference to FIGS. 9 and 10.

Figure 9:
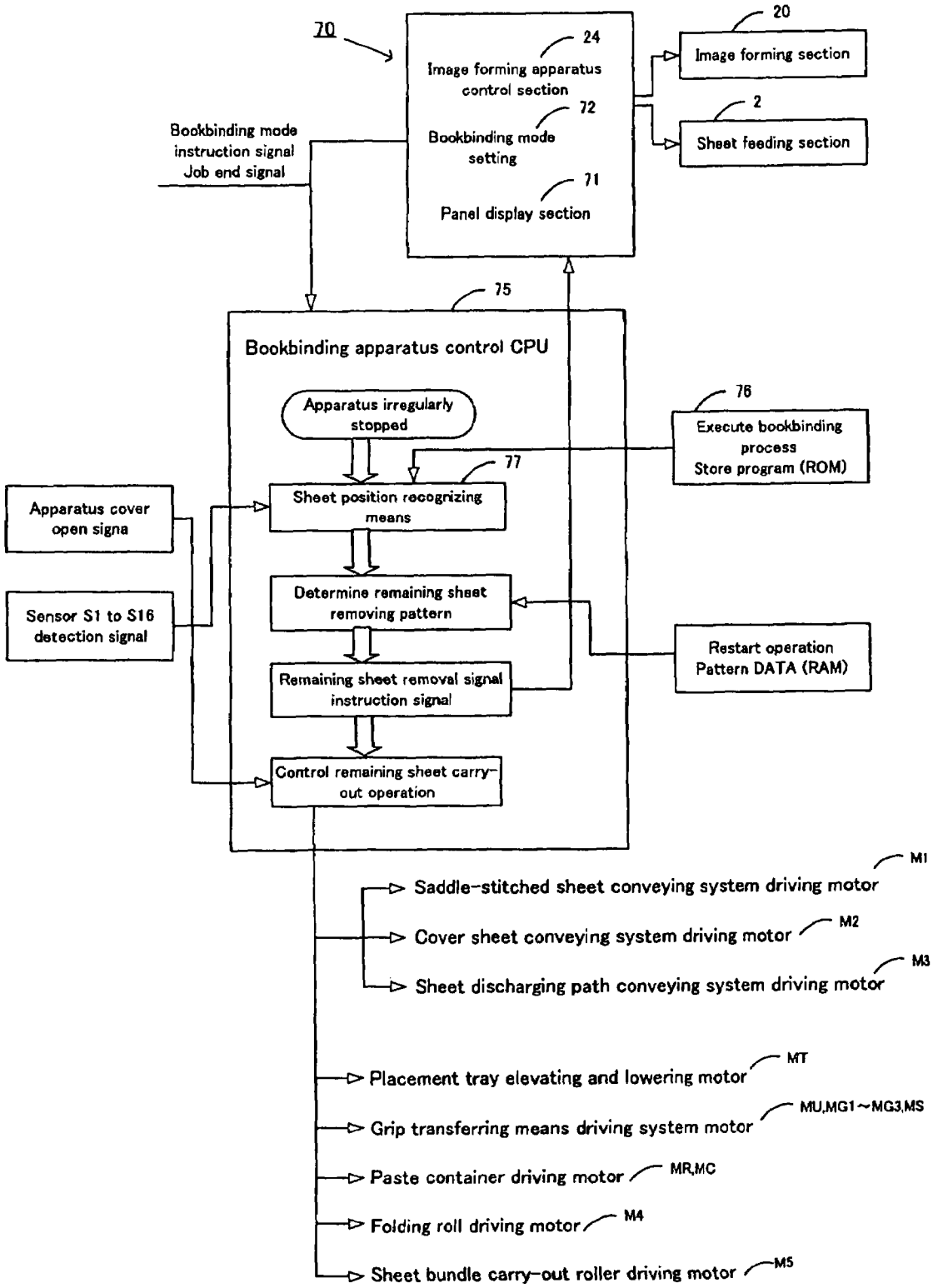
FIG. 9 is a block diagram showing the configuration of control means (control CPU) in the apparatus in FIG. 2.
Figure 10:
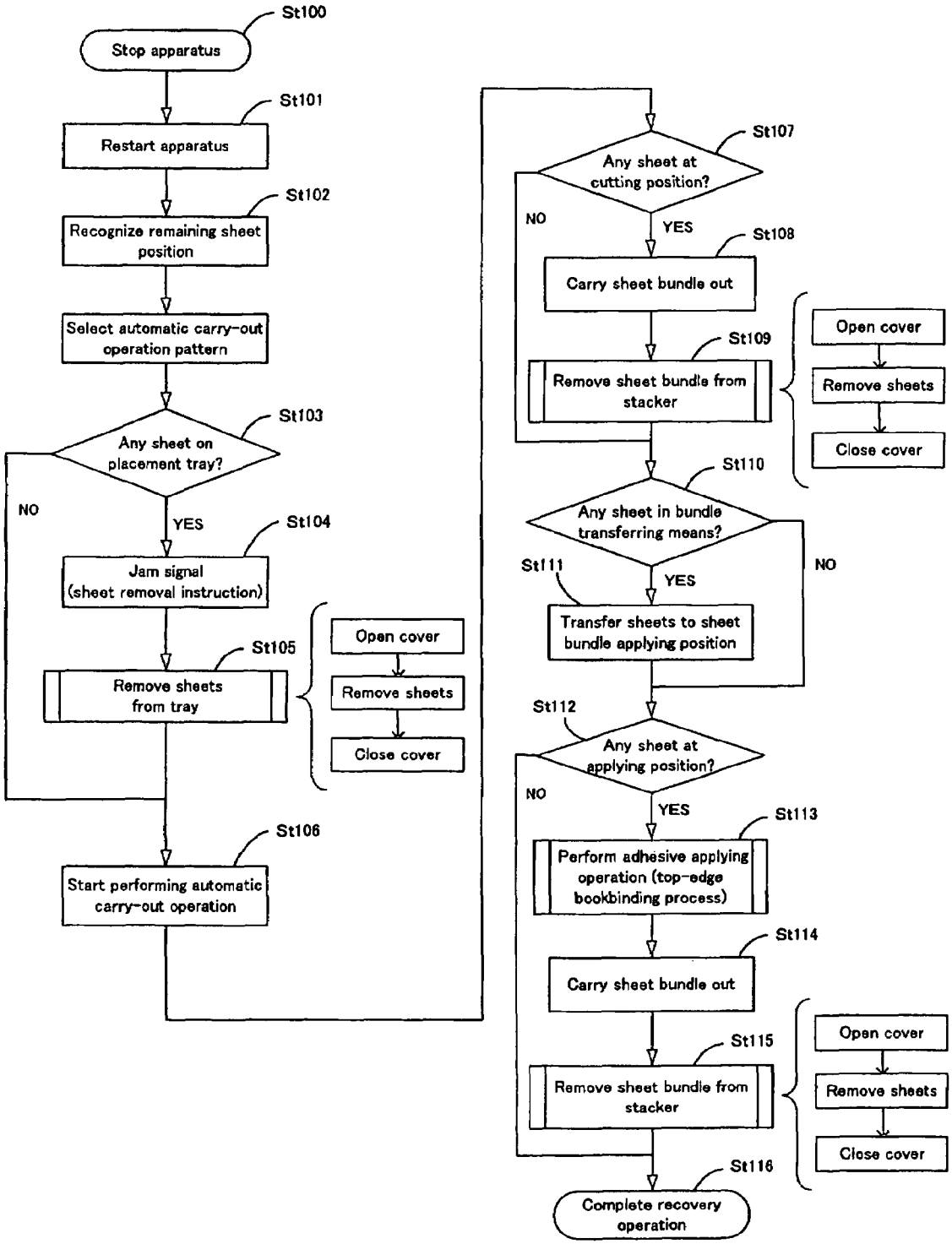
FIG. 10 is a flowchart showing the control procedure of control means in FIGS. 8(*a*)-8(*d*).

FIG. 9 is a block diagram showing a control configuration in the system in FIG. 1. FIG. 10 is a flowchart of an execution program for a bookbinding operation performed when the apparatus is irregularly stopped. In the system in which the image forming apparatus A and booking apparatus B are coupled together as shown in FIG. 1, a control CPU 70 provided in the image forming apparatus A has, for example, a control panel 71 and mode selecting means 72. Then, a selected process, that is, either a printing process mode or a bookbinding process mode, is input via the control panel 71. In the printing process mode, the bookbinding apparatus B allows the path switching flapper 36 to convey printed sheets carried into the sheet carry-in path 31, along the cover sheet conveying path 34 and sheet discharging path 35, shown in FIG. 2, to the finisher device C. The sheets are then placed in a stacker provided in the finisher device C. Accordingly, the printed sheets pass only through the bookbinding apparatus B.

Selection of the "bookbinding process mode" allows the bookbinding apparatus B to guide the printed sheets from the sheet carry-in path 31 to the saddle-stitched sheet conveying path 32. The sheets then pass through the tray 41, the adhesive applying means 55, and the cover sheet binding means 60, and the bound sheets are placed in the housing stacker 67. Thus, selection of the bookbinding process mode allows the control CPU 70 in the image forming apparatus A to simultaneously transmit an instruction signal for the bookbinding mode and information on the size of the printed sheets. Further, for example, if n pages are to be printed, when the final nth page is completely printed, a job end signal corresponding to copy count information is transferred to the control CPU 75 in the bookbinding apparatus B.

The control CPU 75 in the bookbinding apparatus B is composed of a bookbinding control section, an inserter control section, and a cutting control section. The bookbinding control section couples to a driving motor M1 for the conveying rollers located on the sheet carry-in path 31 and saddle-stitched conveying path 32, a driving motor M2 for the conveying rollers located on the cover sheet conveying path 34, a driving motor M3 for the conveying rollers located on the sheet discharging path 35, and a driver circuit for a driving solenoid for the path switching flapper 36. The bookbinding control section also couples to the tray elevating and lowering motor TM for the tray 41, the unit rotating motor MU for the grip conveying means of the grip transferring means 44, the grip motors MG1 to MG3, and a driver circuit for the shift motor MS, which transfers the sheet bundle to the adhesive applying position.

Moreover, the control CPU 75 couples to the roller rotating motor MR, which rotates the application roller 57 for the application of an adhesive and to a driver circuit for the carriage motor MC, which moves the application roller 57 along the sheet bundle Sp. The control CPU 75 also couples to a driving motor M4 for the folding rolls 63 of the cover sheet binding means 60 and to a driver circuit for a driving motor M5 for the bundle carry-out roller 66. On the other hand, the sensors S1 to S16, located on the respective conveying paths, are connected to the control CPU 75 so as to transmit detection signals to it.

Thus, the control CPU 75 invokes the execution program for the bookbinding process from a ROM 76 to perform an operation shown in FIG. 10. During operation, the apparatus is irregularly stopped for some reason (St100). The apparatus is irregularly stopped when power interruption occurs or when the switch for the apparatus power supply is turned off or when the cover of the casing 30 is opened to operate the safety switch or when an error such as jamming occurs in the apparatus. In this case, the apparatus power supply is turned off to suspend the apparatus operation. Then, when the cause of the power interruption is eliminated to turn on the apparatus power supply, the apparatus is restarted (St101). The control CPU 75 then senses the position of the remaining sheets on the basis of status signals from the sensors S1 to S16 (St102) in order to select a preset restart operation. The restart operation is set in patterns 1 to 7 described below.

The control CPU 75 then determines whether or not there is any sheet bundle Sp on the tray 41 (St103). If there is any sheet bundle Sp, this corresponds to a restart operation pattern 1. The control CPU 75 thus issues a jam signal to the image forming apparatus A (St104) to urge the operator to remove the tray sheets (St105). After the sheet bundle Sp is removed, the control CPU 75 starts to perform an operation for automatically carrying the remaining sheets out in accordance with the restart operation pattern (St106). For example, if the sheet bundle Sp is located at the cutting position (St107), the control CPU 75 drives the carry-out roller 66 (St108) to carry the sheet bundle Sp out to the housing stacker 67. The control CPU then issues an overflow signal to urge the operator to remove the sheet bundle Sp (St109). The control CPU 75 then determines whether or not any sheet bundle Sp remains in the sheet bundle conveying means 44 (St 110) to perform any of the patterns 3 to 7 described below (St111 to St114). When this restart operation is finished, the control CPU 75 issues a recovery operation end signal to the image forming apparatus A (St116). A normal bookbinding process operation is subsequently continued.

Restart Operation Pattern 1

If, when the apparatus is irregularly stopped, any sheet bundle Sp remains on the tray 41 and the tray 41 is at the collection position (the position shown with a full line in FIG. 2), the control CPU 75 performs an operation of releasing the first gripper 46. This enables the sheets to be removed from the tray 41. That is, a sheet position recognizing means 77 of the control CPU 75 uses the tray sensor S5, which senses the presence or absence of a sheet on the tray 41, and the tray position sensor S6, which detects the elevated and lowered positions of the tray 41, to recognize that remaining sheets are present on the tray 41 (S5=1) and that the tray 41 is located at the collection position (S6=1). Under this recognition, the control CPU 75 drives the gripper motor MG1 to move the first gripper means 46 to a release position. Then, the control CPU 75 issues a jam signal to the image forming apparatus A to display "Remove Sheets from Tray" on the control panel 71 to urge the operator to remove the remaining sheets from the tray 41.

Restart Operation Pattern 2

If, when the apparatus is irregularly stopped, any sheet bundle Sp remains on the tray 41 and the tray 41 is not at the collection position (the position shown with a full line in FIG. 2), the control CPU 75 moves the tray 41 backward to the collection position (home position) and then performs an operation of releasing the gripping of the first gripping means 46. When the tray 41 is at the carry-out position (shown with a chained line in FIG. 2) or is moving, it is moved backward (upward in FIG. 2). Once the tray 42 returns to its home position, the grippers 46*a* and 46*b* are released. That is, when S5=1 and S6=0, the control CPU 75 reversely rotates the tray elevating and lowering motor MT (tray elevating direction) to return the tray 41 to its home position. Then, when S7=1, the control CPU 75 drives the gripper motor MG1 to move the first gripper means 46 to a released position. The control CPU 75 then issues a jam signal to the image forming apparatus A and displays "Remove Sheets from Tray" on the control panel 71 to urge the operator to remove the remaining sheets from the tray 41.

Restart Operation Pattern 3

If, when the apparatus is irregularly stopped, no paste has been applied yet to the sheet bundle Sp at the adhesive applying position (processing position) and no cover sheet Sh is present on the cover sheet conveying path 34, a top-edge-pasting bookbinding process operation is performed. That is, the sheet position recognizing means 77 determines this condition via the grip sensor S7 for the second gripper means 47, the sheet sensors S13 and S14 for the cover sheet conveying path 34, and the paste container HP sensor S8. For example, when S7=1, S13=0 and S14=0, and S8=1, the sheet position recognizing means 77 determines that the sheet bundle Sp is held by the second gripper means 47 with no paste applied to the sheet bundle Sp yet. The control CPU 75 rotationally drives the shift motor MS for the second gripper means to place the sheet bundle Sp at the adhesive applying position (processing position) E.

Then, the control CPU 75 adjusts the temperature of the paste container 56 and then performs a paste applying operation. The paste applying operation involves causing the carriage motor MC to reciprocate the paste container 56, while causing the roller rotating motor MR to rotate the application roller 57. After the applying operation, the control CPU 75 restarts the shift motor MS for the second gripper means 47 to deliver the sheet bundle Sp to the folding rolls 63 of the bookbinding process path (sheet bundle conveying path) 33. The folding rolls 63 then convey the nipped sheet bundle downstream. The carry-out roller 66 then carries the sheet bundle out to the housing stacker 67. In this operation, the sheet bundle Sp gripped by the gripper means 47 is conveyed to the adhesive applying position (processing position) E, where an adhesive is applied to the sheet bundle Sp. The sheets bound together with the adhesive applied to their top edges are then placed in the housing stacker 67. Then, the control CPU 75 issues, for example, a stack over signal to the image forming apparatus A to urge the operator to remove the sheet bundle.

Restart Operation Pattern 4

If, when the apparatus is irregularly stopped, no paste has been applied yet to the sheet bundle Sp at the adhesive applying position (processing position) with any cover sheet Sh present on the cover sheet conveying path 34, a top-edge-pasting bookbinding process operation is performed. That is, the sheet position recognizing means 77 determines this condition via the grip sensor S7 for the second gripper means 47, the sheet sensors S13 and S14 for the cover sheet conveying path 34, and the paste container HP sensor S8. For example, when S7=1, S13=1 and S14=1, and S8=1, the control CPU issues a jam signal to the image forming apparatus A to urge the operator to remove the cover sheet. Then, the control CPU 75 confirms, via the sheet sensors S13 and S14, that the cover sheet Sh has been removed from the cover sheet conveying path 34 and then performs the same process operation as that of the restart operation pattern 3.

Restart Operation Pattern 5

If, when the apparatus is irregularly stopped, a paste is being applied to the sheet bundle Sp at the adhesive applying position (processing position) with any cover sheet Sh present on the cover sheet conveying path 34, the subsequent top-edge-pasting bookbinding process operation is performed. That is, the sheet position recognizing means 77 determines this condition via the grip sensor S7 for the second gripper means 47, the sheet sensors S13 and S14 for the cover sheet conveying path 34, and the paste container HP sensor S8. For example, when S7=1, S13=1 and S14=1, and S8=0, the control CPU 75 first adjusts the temperature of the paste container 56. This is because the paste container 56 may be away from the home position HP and be in contact with the sheet bundle Sp with the adhesive solidified during the irregular stop of the apparatus. Thus, the control CPU 75, for example, heats the paste container 56 to melt the adhesive. After adjusting the temperature of the paste container 56, the control CPU 75 moves the paste container 56 to the home position HP. In this state, the paste container HP sensor shows "1", resulting in the same conditions as those for the restart operation pattern 4. Thus, the control CPU 75 performs the same operation as that described above.

Restart Operation Pattern 6

If the sheet bundle Sp remains downstream of the adhesive applying position (processing position) when the apparatus is irregularly stopped, the control CPU 75 does not execute the subsequent process on the sheet bundle Sp and carries it out to the housing stacker 67. That is, the sheet position recognizing means 77 detects this condition via the sheet sensors S9, S10, and S11. When any of the sensors shows "1" indicating the presence of a sheet, the control CPU 75 drives the folding rolls 63 and the carry-out roller 66 to carry the remaining sheet bundle out to the housing stacker 67. The control CPU 75 subsequently issues, for example, a stack over signal to the image forming apparatus A to urge the operator to remove the sheet bundle.

Restart Operation Pattern 7

If, when the apparatus is irregularly stopped, no paste has been applied yet or a paste is being applied to the remaining sheets at the adhesive applying position (processing position) E, with a remaining sheet bundle present downstream of the adhesive applying position (processing position) E and with any cover sheet Sh present on the cover sheet conveying path 34, the control CPU 75 sequentially perform the following operation. When all the sheet sensors S9, S10, and S11 show "1", the control CPU 75 moves the second gripper means 47 to its home position, located above the cover sheet binding position F. The control CPU 75 then issues a jam signal to the image forming apparatus A to urge the operator to remove the cover sheet Sh. The control CPU 75 confirms, via the sheet sensors S13 and S14, that the cover sheet Sh has been removed and then performs the operation for the pattern 6. In this operation, the sheet bundle remaining downstream of the adhesive applying position (processing position) E is carried out to the housing stacker 67, from which the operator removes the sheet bundle. The control CPU 75 subsequently performs the operation for the pattern 4 or 5. In this operation, the sheet bundle remaining upstream of the adhesive applying position (processing position) E is subjected to a top-edge-pasting process and then carried out to the housing stacker 67, from which the operator removes the sheet bundle.

The present invention relates to the control of the first gripper means 46 for the restart operation patterns 1 and 2. The grippers 46*a* and 46*b* gripping the sheets on the tray 41 operate in the order of FIGS. 4(*a*), 4(*b*), and 4(*c*).

Thus, (1) if, when the apparatus is irregularly stopped, the sheet position recognizing means 77 determines that a sheet bundle Sp is present on the tray 41 and that the tray 41 is at the collection position (shown with a full line in FIG. 2), an operation of releasing the grippers 46*a* and 46*b* of the first gripper means 46 is performed. That is, when the apparatus is stopped in the condition shown in FIG. 4(*b*), such an operation as returns the condition to the one shown in FIG. 4(*a*) is performed. This control is performed by reversing the gripper motor MG1 to move, via a position sensor (not shown), the movable gripper (upper gripper) upward and away from the sheet bundle Sp. Then, the width-wise moving motor MG2 is reversed to move the gripper in the sheet width direction so that the gripper returns to its home position. The motors MG1 and MG2 are composed of stepping motors and are initialized by moving them by a predetermined amount via a command signal from the control CPU 75 indicating the number of steps.

(2) If, when the apparatus is irregularly stopped, a sheet bundle Sp is present on the tray 41 and the tray 41 is not at the collection position (shown with a full line in FIG. 2), an operation of releasing the gripping of the first gripper means 46 is performed. When the tray 41 is at the carry-put position (shown with a chained line in FIG. 2) or is moving, it is moved backward (upward in FIG. 2) to its home position. Then, the grippers 46*a* and 46*b* are released. In this case, the control CPU 75 reverses the tray elevating and lowering motor MT to change the condition shown in FIG. 4(*c*) to the condition shown in FIG. 4(*b*) until the tray position sensor S6 is turned on.

Subsequently, the gripper motor MG1 and the width-wise motor MG2 are reversed to return the condition to the one shown in FIG. 4(*a*). This allows the operator to remove the sheet bundle Sp gripped by the first gripper means 46 from the tray 41 returned to the collection position.

Now, description will be given of a method for conveying a sheet bundle in accordance with the present invention. Since this method is implemented by the operations of the above mechanisms, the description is based on the above configuration. The method allows the grip transferring means 44 to grip and transfer the sheet bundle Sp from a collecting stage on which sheets are collected in a bundle, for example, the tray 41, to a predetermined position (adhesive applying position E). The method comprises a sheet collecting step of collecting sequentially carried out sheets on the collection stage such as the tray in a predetermined posture. This step is executed by, for example, sequentially collecting sheets on the tray 41 via the saddle-stitched sheet conveying path 32.

The method comprises a subsequent sheet bundle gripping step of allowing the grip transferring means 44 to grip the sheet bundle Sp on the collection stage. This step is executed by allowing the first gripper means 46 to grip the sheet bundle Sp on the tray 41. The method comprises a subsequent sheet bundle transferring step of moving the grip transferring means 44 to a predetermined processing position to convey the sheet bundle Sp. This step is executed by allowing the second gripper means 47 to transfer the sheet bundle Sp to the processing position E.

On the other hand, the method comprises an error detecting step of detecting an error in the apparatus. In this step, for example, jamming is detected on the basis of the conditions of the sensors S1 to S16. Further, whether or not any opening and closing has been inadvertently opened is detected on the basis of the conditions of the covers 30*a* to 30*f*, disposed on the casing 30. If any opening and closing has been inadvertently opened, the apparatus power supply is turned off. Similarly, this step is executed by determining the occurrence of an error when the apparatus power supply is turned off by power interruption or the like. The method comprises a subsequent sheet bundle returning step of allowing, when an error is detected in the error detecting step, the grip transferring means to move the sheet bundle being transferred, backward to the collection stage and a subsequent grip releasing step of releasing the gripping of the sheet bundle on the collection stage. These steps are executed by the operations described above for the first gripper means 46.

The disclosure of Japanese Patent Application No. 2006-106688 filed on Apr. 7, 2006 is incorporated as a reference.

While the invention has been explained with reference to the specific embodiments of the invention, the explanation is illustrative and the invention is limited only by the appended claims.

What is claimed is:

1. A sheet bundle conveying device comprising:

tray means for holding sheets on which sheets are placed and held in a bundle;

a sheet bundle conveying path along which the sheet bundle from the tray means is guided to a predetermined processing position;

grip transferring means located on the sheet bundle conveying path for gripping and transferring the sheet bundle from the tray means to a processing position; and grip controlling means for controlling the grip transferring means, wherein when an apparatus error occurs, the grip controlling means moves the grip transferring means backward along the sheet bundle conveying path and cancels gripping to return the sheet bundle being transferred to the tray means.

2. The sheet bundle conveying device according to claim 1, wherein the grip transferring means comprises first gripper means for carrying the sheet bundle out from the tray means located on an upstream side of the sheet bundle conveying path and second gripper means for receiving the sheet bundle from the first gripper means and conveying the sheet bundle to the adhesive applying position located on a downstream of the sheet bundle conveying path, and when an apparatus error occurs, the grip controlling means moves at least the first gripper means backward along the sheet bundle conveying path and cancels gripping to return the sheet bundle being transferred to the tray means.

3. The sheet bundle conveying device according to claim 1, wherein the tray means is placed in a horizontal direction so as to hold the sheets in a substantially horizontal posture, and the grip transferring means changes the posture of the sheet bundle from the tray means to a vertical one and then transfers the sheet bundle to the processing position.

4. A bookbinding apparatus comprising:

tray means for holding sheets on which sequentially carried out sheets are collected in a bundle;

a sheet bundle conveying path along which a sheet bundle from the tray means is guided to an adhesive applying position;

grip transferring means located on the sheet bundle conveying path for gripping and transferring the sheet bundle from the tray means to the adhesive applying position;

grip control means for controlling the grip transferring means;

adhesive applying means located at the adhesive applying position for applying an adhesive to the sheet bundle supported by the grip transferring means;

cover sheet binding means located on the sheet bundle conveying path for binding a cover sheet to the sheet bundle from the adhesive applying position; and a cover sheet conveying path along which the cover sheet is fed to the cover sheet binding means, wherein when an apparatus error occurs, the grip control means moves the grip transferring means backward along the sheet bundle conveying path and cancels gripping to return the sheet bundle being transferred, to the tray means.

5. The bookbinding apparatus according to claim 4, wherein the grip transferring means comprises first gripper means for carrying the sheet bundle out from the tray means and second gripper means for receiving the sheet bundle from the first gripper means and conveying the sheet bundle to the adhesive applying position, and when an apparatus error occurs, the grip transferring means returns a sheet bundle being transferred by the first gripper means, to the tray means, and the grip transferring means transfers a sheet bundle being transferred by the second gripper means, to the adhesive applying position.

6. The bookbinding apparatus according to claim 5, wherein the cover sheet binding means is controlled so as to carry the sheet bundle from the second gripper means, out of the apparatus through the sheet bundle conveying path without binding the cover sheet to the sheet bundle.

* * * * *